US005665303A

United States Patent [19]

Hauck

[11] Patent Number: 5,665,303

[45] Date of Patent: Sep. 9, 1997

[54] ARRANGEMENT FOR HEAT TREATMENT OF STEEL WIRE

[75] Inventor: Albert Hauck, Hilchenbach, Germany

[73] Assignee: SMS Schloeman-Siemag Aktiengesellschaft, Düsseldorf, Germany

[21] Appl. No.: 543,188

[22] Filed: Oct. 13, 1995

[30] Foreign Application Priority Data

Oct. 14, 1994 [DE] Germany ..... 44 36 712.0

[51] Int. Cl.[6] ..... C21D 9/56

[52] U.S. Cl. ..... 266/106; 148/601

[58] Field of Search ..... 266/103, 106; 148/601

[56] References Cited

U.S. PATENT DOCUMENTS 4,242,153 12/1980 Vitelli et al. ..... 266/106
4,982,935 1/1991 Nonini et al. ..... 266/106

FOREIGN PATENT DOCUMENTS 0603707 6/1994 European Pat. Off. .
0211292 11/1994 Germany .

*Primary Examiner*—Scott Kastler
*Attorney, Agent, or Firm*—Friedrich Kueffner

[57] ABSTRACT

In an arrangement for heat treatment of steel wire, the wire, after emerging from a continuous wire rolling mill, is placed by a laying head onto a horizontal conveyor and is transported on the horizontal conveyor in the form of a row of successive and overlapping loops. The wire is subjected to surface treatment during the transport and is collected at the end of the conveyor by a loop collecting unit to form a wire coil and is transferred to a coil conveying unit. Behind the laying head, a second loop collecting unit which can be moved into and out of the conveying path of the horizontal conveyor is provided. The second loop collecting unit includes a coil conveyor with transfer units which can be operated as selected for transferring the wire coils to coil heating units or to coil cooling units.

5 Claims, 1 Drawing Sheet

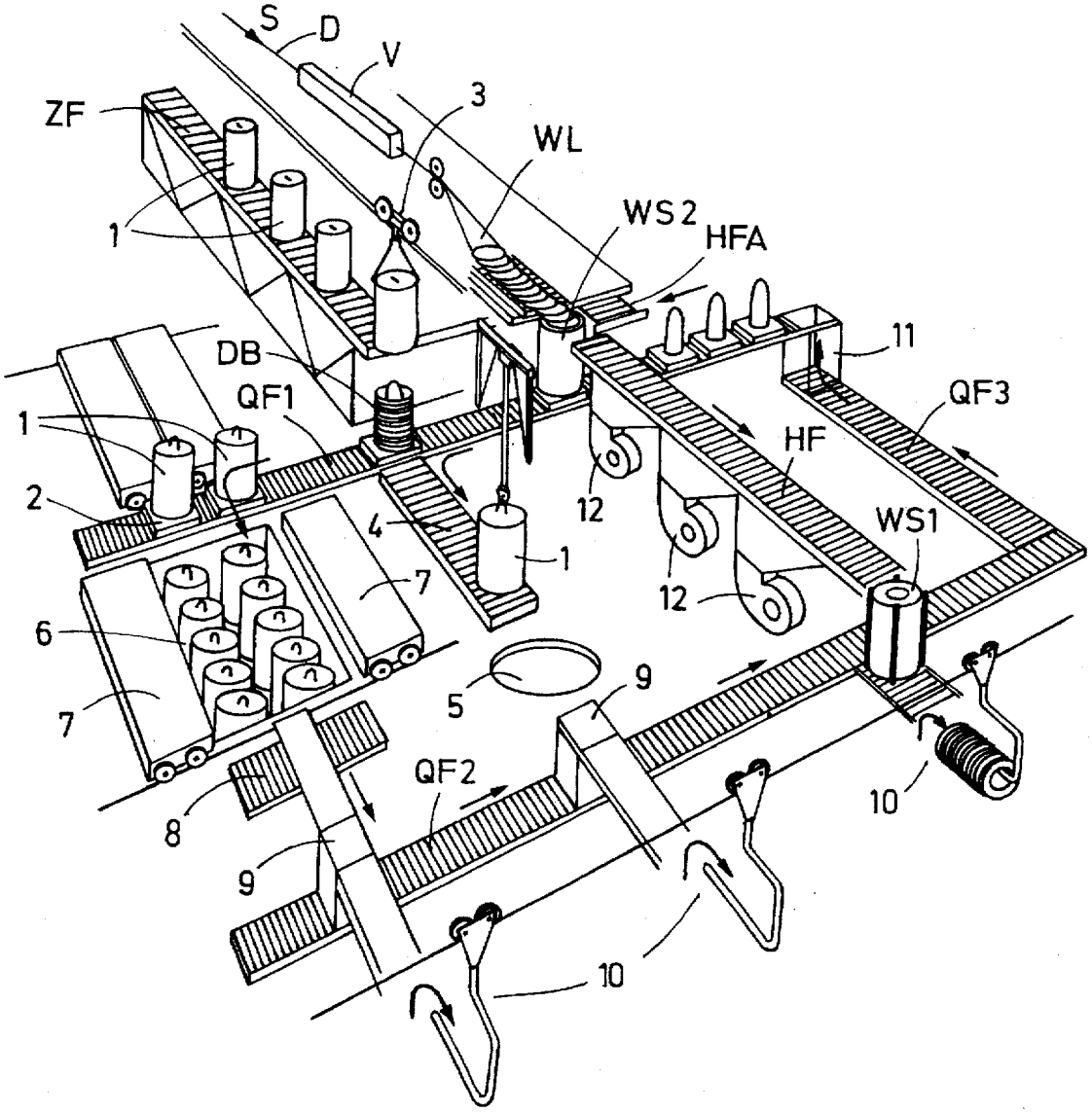
S
D
V
3
ZF
WL
1
WS2
HFA
11
DB
QF1
QF3
1
HF
2
12
4
WS1
1
7
12
6
5
9
7
QF2
10
8
9
10

ARRANGEMENT FOR HEAT TREATMENT OF STEEL WIRE

BACKGROUND OF THE INVENTION

1. Field of the Invention

The present invention relates to an arrangement for heat treatment of steel wire, wherein the wire, after emerging from a continuous wire rolling mill, is placed by a laying head onto a horizontal conveyor and is transported on the horizontal conveyor in the form of a row of successive and overlapping loops. The wire is subjected to surface treatment during the transport and is collected at the end of the conveyor by a loop collecting unit to form a wire coil and is transferred to a coil conveying unit.

2. Description of the Related Art

In an arrangement of this type, it is possible, while the wire is placed on the horizontal conveyor, to subject the wire to heat treatment or to cool the wire, for example, by applying blown air or by spraying cooling liquids onto the wire loops. It is also known in the art to place heat insulation covers over the horizontal conveyor in order to intensify the heat treatment and to reduce heat loss.

In an arrangement of this type, it is not possible to subject the rolled wire to heat treatment by utilizing most of the rolling heat which is present in the wire after emerging from the rolling mill train. This can be achieved by so-called hood-type annealing means by coiling the wire into a wire coil immediately after emerging from the rolling mill train and covering the wire coil by a heat insulation hood under which the wire coil is slowly cooled down from the heat still present in the wire, or the wire coil can again be heated under the heat insulation hood by supplying heat and then cooling the wire coil, for example, by immersing the wire coil in a water bath after first removing the heat insulation hood.

SUMMARY OF THE INVENTION

Therefore, it is the primary object of the present invention to improve the arrangement of the above-described type in such a way that, without having to interrupt the rolling operation, the wire emerging from the rolling mill train can be subjected as selected to one of the treatments described above.

In accordance with the present invention, this object is met by providing behind the laying head a second loop collecting unit which can be moved into and out of the conveying path of the horizontal conveyor. The second loop collecting unit includes a coil conveyor with transfer units which can be operated as selected for transferring the wire coils to coil heating units or to coil cooling units.

The horizontal conveyor behind the laying head may include a conveyor portion which can be moved transversely out of the conveyor path and can be replaced by the loop collecting unit. The coil conveyor may include a transverse conveyor for introducing empty coil support pallets into the loop collecting unit and for removing the coil support pallets from the loop collecting unit after a wire coil has been placed on the coil support pallet. The conveying plane of the transverse conveyor extends below a unit for placing heat insolation hoods onto the coil support pallets which have been removed from the loop collecting unit and which carry a wire coil. The unit for placing the heat insulation hoods can be actuated as selected.

In conveying direction following the unit for placing the heat insolation hoods, the transverse conveyor may include a lifting device for laterally placing the coil support pallets with the wire coils covered by heat insulation hoods into a thermally insulated storage area which can be covered and heated.

The transverse conveyor may additionally have in conveying direction behind the unit for placing the heat insulation hoods a lifting device for laterally placing and immersing the coil support pallets with the wire coils in a water bath.

The units for laterally placing the coil support pallets in a storage area or in a water bath can advantageously be arranged at the side of the transverse conveyor facing away from the laying head. The storage area or the water bath may be provided with intermediate conveyors which extend parallel to the horizontal conveyor and end in front of transfer units which are arranged above a common second transverse conveyor. The transfer units transfer the wire coil to a further conveying unit and place the corresponding empty coil support pallets onto the second transverse carrier which is connected through another intermediate conveyor to the first transverse conveyor.

The arrangement according to the present invention makes it possible, after the wire emerging from the wire rolling mill has been placed in the form of successive and overlapping loops onto the horizontal conveyor, to subject the wire to heat treatment on the horizontal conveyor by means of air or spray water and then to introduce the wire into the loop collecting unit arranged at the end of the horizontal conveyor and to convey away the wire coil formed in the loop collecting unit. However, if desired, the wire emerging from the wire rolling mill can also be collected into a wire coil in the loop collecting unit arranged directly following the laying head in the conveying path of the horizontal conveyor and the wire coil can be placed on a coil support pallet; subsequently, the wire coil can be conveyed underneath the unit for placing heat insulating hoods and can either be covered with the heat insulating hoods and transported to the lifting device for laterally placing the coil support pallet in a storage area for wire coils or to the lifting device for laterally placing the coil support pallet with the wire coil into a water bath.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic perspective view of the arrangement for heat treatment of steel wire according to the present invention.

DESCRIPTION OF THE PREFERRED EMBODIMENTS

The wire D arriving from a continuous rolling mill train, not shown, in the direction of arrow S initially travels through a precooling unit V and then into the laying head WL which places the wire D in successive and overlapping loops, also not shown, onto the horizontal conveyor HF. A loop collecting unit WS1 in the form of a vertical collecting chute is provided at the end of the horizontal conveyor HF.

As illustrated in the drawing, the horizontal conveyor HF is interrupted following the laying head WL and a horizontal conveyor portion HFA has been moved laterally transversely out of the conveying path and a second loop collecting unit WS2 has been moved into the conveying path in place of the horizontal conveyor portion HFA. A transverse conveyor QF1 is arranged underneath the horizontal conveyor HF. The conveying path of the transverse conveyor QF1 extends perpendicularly to the conveying path of the horizontal conveyor HF. The transverse conveyor QF1 serves to receive and convey coil support pallets 2. In the drawing, the coil support pallets have vertical collecting mandrels. A supply conveyor ZF for heat insulation hoods 1 is arranged above the transverse conveyor QF1 and extending parallel to the horizontal conveyor HF. Arranged at the end of this supply conveyor ZF and in front of the transverse conveyor QF1 is a unit 3 for placing the heat insulation hoods 1 onto the coil support pallets 2 with the wire coils DB on the transverse conveyor QF1.

An intermediate conveyor 4 which ends in front of an immersion bath 5 is arranged laterally of the transverse conveyor QF1 and on the side facing away from the laying head WL. This intermediate conveyor 4 is provided with a lifting device, not shown, for moving the coil support pallets 2 with or without heat insulation hoods 1 placed on the wire coils into and out of the immersion bath 5. A storage area 6 in the form of a pit which can be closed with movable covers 7 is also arranged on the side of the transverse conveyor QF1 facing away from the laying head WL. The coil support pallets 2 with the wire coils and the heat insulation hoods 1 covering the wire coils on the transverse conveyor QF1 can be moved by means of a lifting device, not shown, into the pit 6 and can be moved out of the pit 6 and placed on an intermediate transverse conveyor 8.

A second transverse conveyor QF2 is arranged parallel to the first transverse conveyor QF1, wherein the conveying path of the second transverse conveyor QF2 extends below the horizontal conveyor HF. In the areas behind the immersion bath 5 and the storage area 6, the second transverse conveyor QF2 is provided with transfer units, not shown, for the coil support pallets 2 with the wire coils DB and possibly the heat insulation hoods 1 removed from the immersion bath 5 or the storage area 6. The second transverse conveyor QF2 also has coil transfer units 9 which lift the wire coils DB from the coil support pallets 2 and onto hook-type conveyors 10. The transverse conveyor QF2 ends at another transverse conveyor QF3 which is connected to the first transverse conveyor QF1 through a lifting unit 11.

The wire is subjected to heat treatment as it is being conveyed on the horizontal conveyor HF, for example, by directing air against the wire by means of blowers 12 arranged underneath the horizontal conveyor HF, and the loops treated in this manner are collected in the loop collecting unit WS into a wire coil DB which is then transferred to the subsequently arranged hook-type conveyor 10. In this mode of operation, the horizontal conveyor portion HFA has been moved into the conveying path of the horizontal conveyor HF. This position of the horizontal conveyor portion HFA is not shown in the drawing.

If the wire D emerging from the wire rolling mill is to be subjected to heat treatment, the horizontal conveyor portion HFA is laterally moved out of the conveying path of the horizontal conveyor HF, as illustrated in the drawing, and the loop collecting unit WS2 is moved in its place into the conveying path of the horizontal conveyor HF. The loops placed by the laying head WL onto the horizontal conveyor HF are then collected in the loop collecting unit WS into a wire coil DB on the coil support pallet 2 located in the loop collecting unit WS and the transverse conveyor QF1 moves the coil support pallet 2 with wire coil DB from the loop collecting unit WS into the position, also shown in the drawing, in front of the intermediate conveyor 4 and is covered at this location by a heat insulation hood 1 which is placed over the wire coil by means of the unit 3. The coils DB can then either be moved from this position by the intermediate conveyor 4 into the immersion bath 5 and subsequently by the coil transfer unit 9 onto the hook-type conveyor 10. Alternatively, the coils DB can be placed by means of a lifting device, not shown, into the storage area 6 and, after the heat treatment has been completed, can be moved from the storage area 6 by the intermediate transverse conveyor 8 to the coil transfer unit 9 and onto the hook-type conveyor 10. In both cases, the heat insulation hoods 1 removed in the coil transfer unit 9 from the coil support pallets 2 and the wire coils DB are conveyed by means of the second transverse conveyor QF2 and the additional transverse conveyor QF3 to the transverse conveyor QF1 to be used again in the loop collecting unit WS2.

While specific embodiments of the invention have been shown and described in detail to illustrate the inventive principles, it will be understood that the invention may be embodied otherwise without departing from such principles.

I claim:

1. An arrangement for heat treatment of steel wire emerging from a continuous wire rolling mill, the arrangement comprising a horizontal conveyor, a laying head for placing the steel wire in the form of a row of successive and overlapping loops onto the horizontal conveyor, means for subjecting the steel wire to heat treatment while placed on the horizontal conveyor, the horizontal conveyor having an end, a loop collecting unit for collecting the steel wire into a wire coil at the end of the horizontal conveyor, further comprising a second loop collecting unit, the second loop collecting unit being moveable into and out of a conveying path of the horizontal conveyor behind the laying head, and coil conveyor units connected to the second loop collecting unit, the coil conveyor unit comprising transfer units for transferring the wire coils to at least one of a coil heating unit and a coil cooling unit, wherein the horizontal conveyor comprises behind the laying head a conveyor portion, the conveyor portion being moveable transversely out of the conveying path of the horizontal conveyor and being replaceable by the second loop collecting unit, and wherein the coil conveyor unit comprises a first transverse conveyor for conveying empty coil support pallets into the loop collecting unit and for conveying coil support pallets with wire coils out of the second loop collecting unit, wherein a conveying path of the first transverse conveyor is located underneath a unit for placing heat insulation hoods onto the coil support pallets which have been moved out of the second loop collecting unit and loaded with wire coils.

2. The arrangement according to claim 1, wherein the first transverse conveyor comprises, in a conveying direction behind the unit for placing the heat insulation hoods, a lifting device for laterally placing the coil support pallets with the wire coils covered by the heat insulation hoods into a thermally insulated collecting area, wherein the storage area comprises means for covering and heating the storage area.

3. The arrangement according to claim 1, wherein the first transverse conveyor comprises, in a conveying direction behind the unit for placing the heat insulation hoods, a lifting device for laterally placing and immersing the coil support pallets in a water bath.

4. The arrangement according to claim 3, wherein the lifting device for laterally placing the coil support pallets in a storage area is located on a side of the first transverse conveyor facing away from the laying head, further comprising an intermediate conveyor extending parallel to the horizontal conveyor, a second transverse conveyor and coil transfer units located above the second transverse conveyor, the intermediate conveyor extending between the storage area and the coil transfer unit, and a third transverse conveyor for connecting the second transverse conveyor to the first transverse conveyor, wherein the coil transfer unit serves to transfer the wire coil to a further conveying unit and to place empty coil collecting pallets onto the second transverse conveyor.

5. The arrangement according to claim 4, wherein the lifting device for laterally placing the coil support pallets in a water bath is located on a side of the first transverse conveyor facing away from the laying head, further comprising an intermediate conveyor extending parallel to the horizontal conveyor, a second transverse conveyor and coil transfer units located above the second transverse conveyor, the intermediate conveyor extending between the water bath and the coil transfer unit, and a third transverse conveyor for connecting the second transverse conveyor to the first transverse conveyor, wherein the coil transfer unit serves to transfer the wire coil to a further conveying unit and to place empty coil collecting pallets onto the second transverse conveyor.

* * * * *